US007985147B1

(12) United States Patent
Allen

(10) Patent No.: US 7,985,147 B1
(45) Date of Patent: Jul. 26, 2011

(54) SWING TRAINING DEVICE

(76) Inventor: Shawn Allen, Washington, PA (US)

( * ) Notice: Subject to any disclaimer, the term of this patent is extended or adjusted under 35 U.S.C. 154(b) by 0 days.

(21) Appl. No.: 12/807,655

(22) Filed: Sep. 10, 2010

(51) Int. Cl.
*A63B 69/00* (2006.01)

(52) U.S. Cl. ..... 473/457

(58) Field of Classification Search ..... 473/457, 473/519, 520, 564–568, 461, 463, 235
See application file for complete search history.

(56) References Cited

U.S. PATENT DOCUMENTS

| | | | | |
|---|---|---|---|---|
| 1,877,820 | A * | 9/1932 | Costello | 473/235 |
| 3,206,195 | A * | 9/1965 | Myers | 473/457 |
| 3,268,226 | A * | 8/1966 | Martino | 473/457 |
| 3,503,611 | A * | 3/1970 | McPherson | 473/463 |
| 3,820,785 | A * | 6/1974 | Occhipinti et al. | 73/463 |
| 4,032,142 | A * | 6/1977 | Andrews | 473/463 |
| 4,063,730 | A * | 12/1977 | Bates | 473/463 |
| 4,139,198 | A * | 2/1979 | Kanavas | 473/236 |
| 4,143,873 | A * | 3/1979 | Andreoli | 473/463 |
| 4,239,215 | A * | 12/1980 | Farr | 473/463 |
| 5,269,511 | A * | 12/1993 | Chavez | 473/457 |
| 5,324,029 | A * | 6/1994 | Kim | 473/463 |
| D358,859 | S * | 5/1995 | Bernardo | D21/725 |
| 5,807,196 | A * | 9/1998 | Pompeo | 473/463 |
| 6,626,774 | B2 * | 9/2003 | Sorbie | 473/524 |
| 2006/0199678 | A1 * | 9/2006 | Benassi | 473/457 |
| 2008/0039241 | A1 * | 2/2008 | Pope | 473/457 |

* cited by examiner

*Primary Examiner* — Mark S Graham
(74) *Attorney, Agent, or Firm* — Richard K Thomson

(57) ABSTRACT

A bat, golf club or stringed racket has the sweet spot replaced by a ring with a ball-catching net secured to a backside thereof to enable the user to develop the necessary hand-eye coordination to consistently engage the optimum portion of the sporting goods device to contact the ball, thereby improving performance/results.

2 Claims, 5 Drawing Sheets

SWING TRAINING DEVICE

BACKGROUND AND SUMMARY OF THE INVENTION

The present invention is directed to the field of sports. More particularly, the present invention is directed to a sports training device to teach the user to routinely contact the ball with the sweet spot of the sporting goods device (bat, racket, club, etc.) to optimize performance.

A number of swing training devices are available on the market for both baseball bats and golf clubs. None of the available references actually provide a satisfactory method of enhancing the user's performance by ensuring contact between the "sweet spot" on the sporting goods device and the ball. Particularly, as it relates to baseball, none of the prior art patents teaches a device which can, through repeated use, lead to enhanced bunting technique.

The swing training device of the present invention is designed to enhance the player's performance through repeated contact with the sweet spot and can be used with baseball bats, tennis rackets, and golf clubs, but is particularly well suited for baseball-hitting training, especially bunting. The swing training aid of the present invention comprises a) a sporting goods device designed to strike a ball of a particular diameter, said sporting goods device having a sweet spot which, when striking the ball, provides optimum results; b) a hole formed in said sporting goods device in a vicinity of the sweet spot, the hole having a dimension which exceeds the particular diameter of the ball to be struck; c) ball catching means secured to the sporting goods device on a rear side of thereof; whereby when the sporting goods device is swung at the ball and the sporting goods device is positioned such that the ball would engage the sweet spot, the ball will be captured in the ball catching means.

The swing training device includes ring means secured in the sporting good device, the ring means including securement means for attaching the ball catching means. The ball catching means comprises a net engaged by the securement means to retain it in contact with said ring means. The swing training device is selected from a group consisting of a baseball bat, a golf club, a stringed racket.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
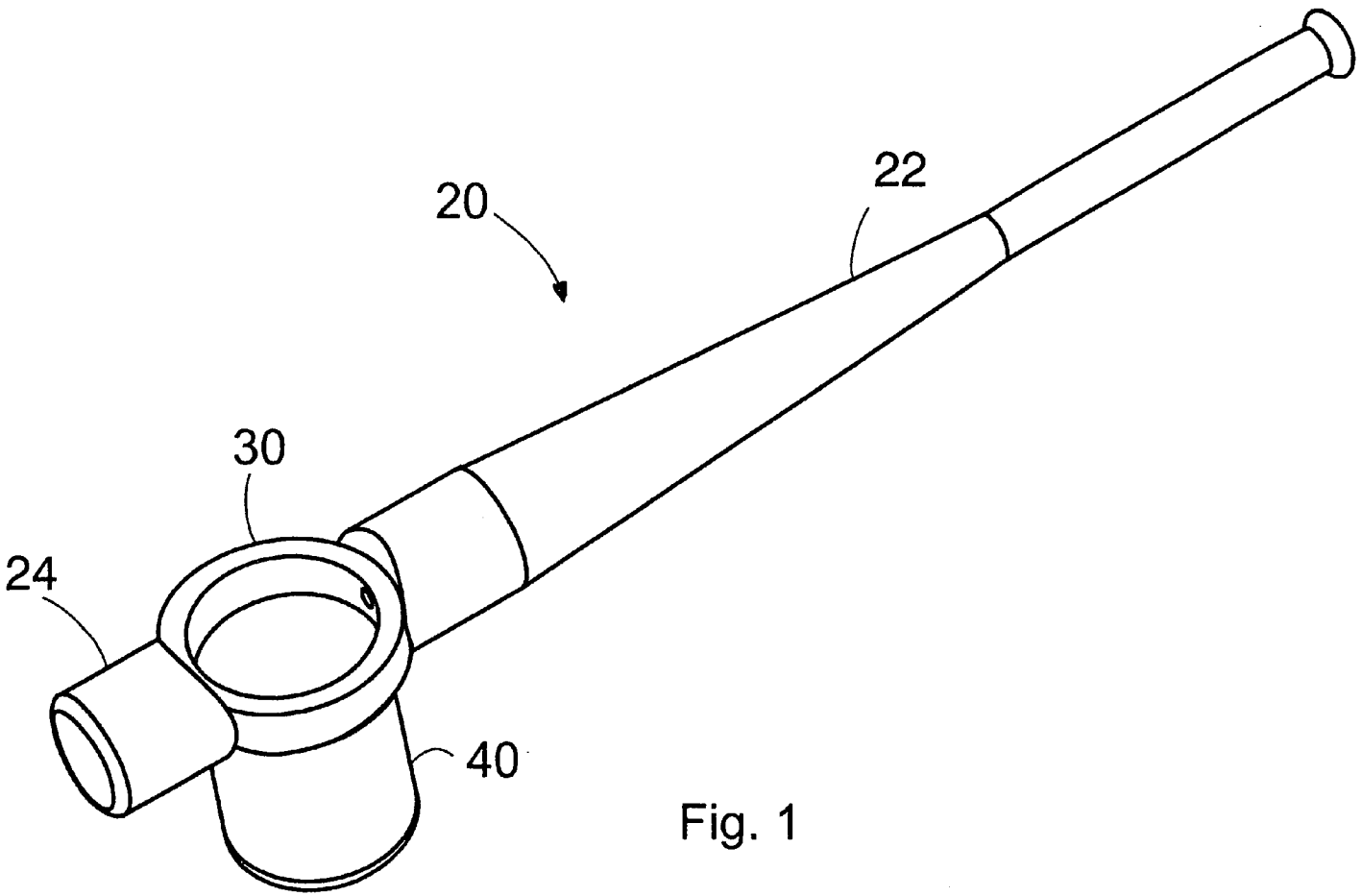
FIG. 1 is a perspective front view of a first embodiment of the swing training device of the present invention.
Figure 2:
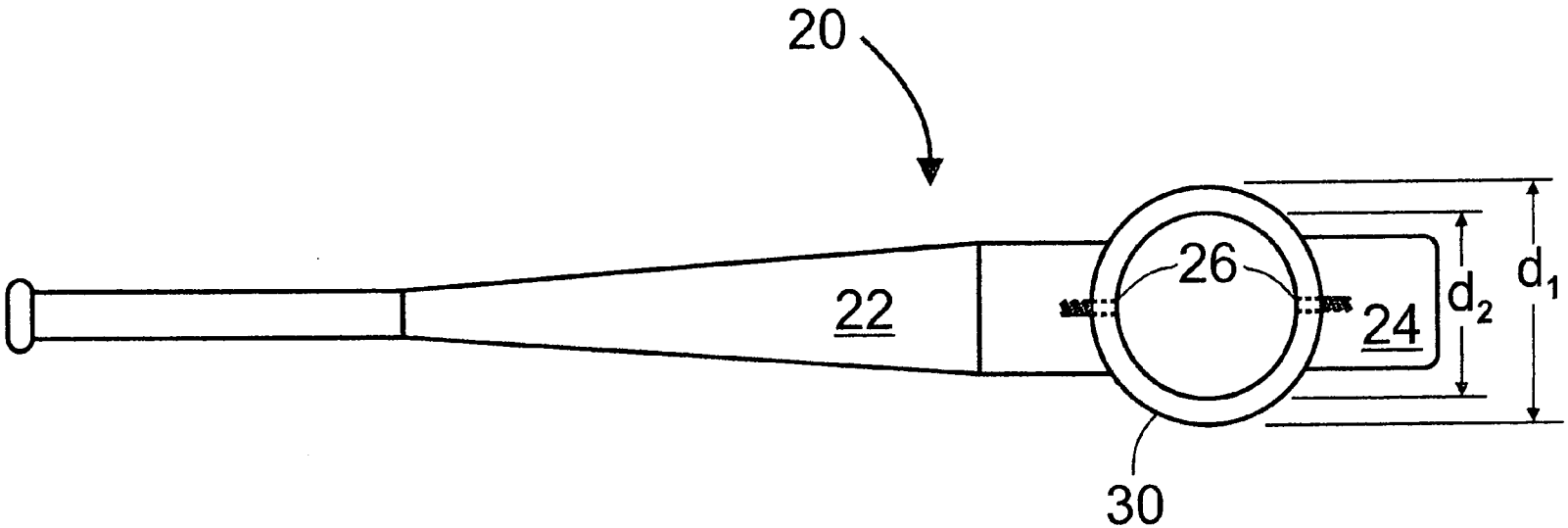
FIG. 2 is a top view of the first embodiment.
Figure 3:
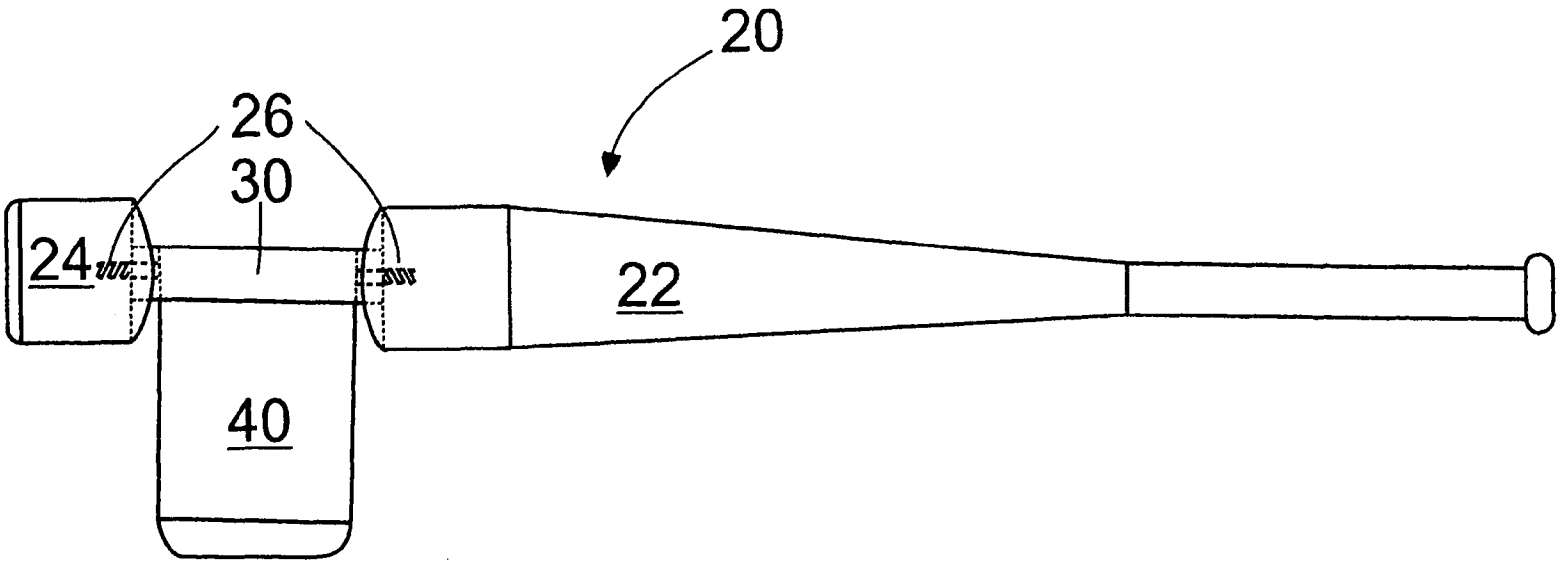
FIG. 3 is a side view of the first embodiment.

A first embodiment of the swing training device of the present invention is depicted in FIGS. 1-3 at 20. Swing training device 20 of the first embodiment is a baseball bat having a first handle portion 22 and a second cap portion 24. The two portions 22, 24 are formed by using a hole saw (not shown) having a diameter identical to the outer diameter $d_1$ (FIG. 2) of ring means 30 to form the hole. Ring means 30 may be made of plastic, wood or metal and is preferably attached to the ring means 30 using wood screws 26. In this first preferred embodiment, bat portions 22, 24 are made of wood. It is contemplated that an aluminum bat might also be used in which case the type of fastener used to attach ring means 30 to bat portions 22, 24 would be altered to accommodate this variation. The inner diameter $d_2$ of ring means 30 exceeds the diameter of the ball with which the swing training device 20 is to be used by ½-1", i.e., for the bat training embodiment, a baseball; for a golf club swing training embodiment, a golf ball; for a racket training embodiment, a tennis/racquet/squash ball. Clearance of ½" is preferred to maximize the benefits of the training device 20 in encouraging the user to precisely find the sweet spot. This tight tolerance will be key in assisting the batter in developing a habit of locating the sweet spot when laying down a bunt, not settling for just any portion of the bat but, rather, learning to use the proper portion of the bat, the sweet spot, to lay down the bunt. A ball catching means, depicted here as a net 40, is secured to the ring means 30. The securement means may include an adhesive, but most preferably, includes a wrap around ring means 30 such that screws 26 penetrate at least two layers of net 40, in addition to the adhesive. Alternatively, hook and loop fabric may be secured to both of ring means 30 and net 40 to permit easy removal/replacement. The material from which net 40 is made must be strong and durable. It is preferred that net 40 be made of a sturdy nylon mesh.

Figure 4:
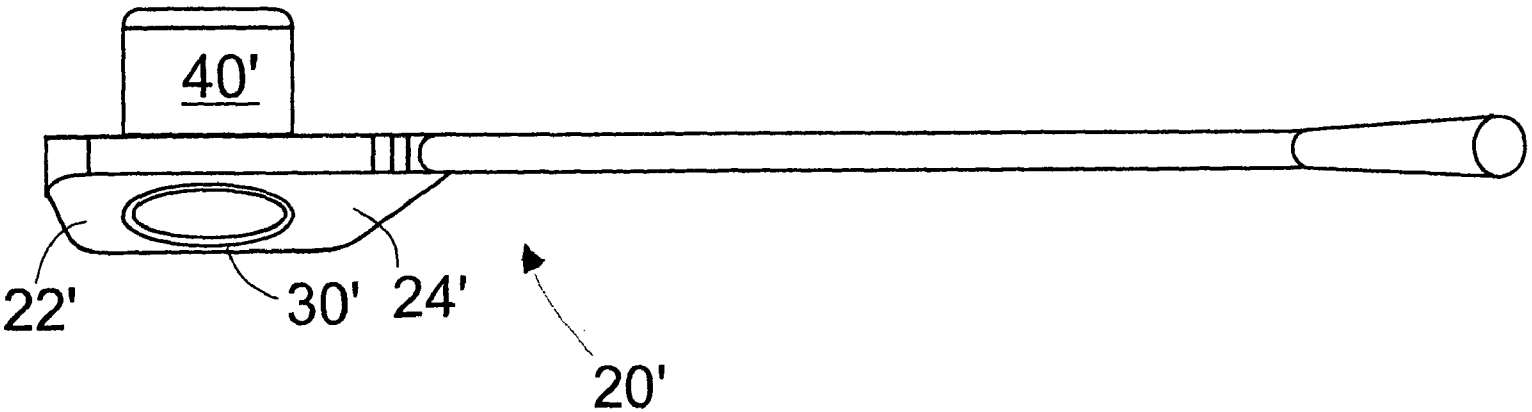
FIG. 4 is a top view of a second embodiment.

A second embodiment of the swing training device of the present invention is depicted generally at 20' in FIG. 4. This embodiment is for swing training of a golf club. Golf club includes a toe portion 22' and a heel portion 24' interconnected by ring means 30' which, in turn, secures net 40' to the club. While FIG. 4 depicts only an iron, obviously the technique may be used with an wood, as well.

Figure 5:
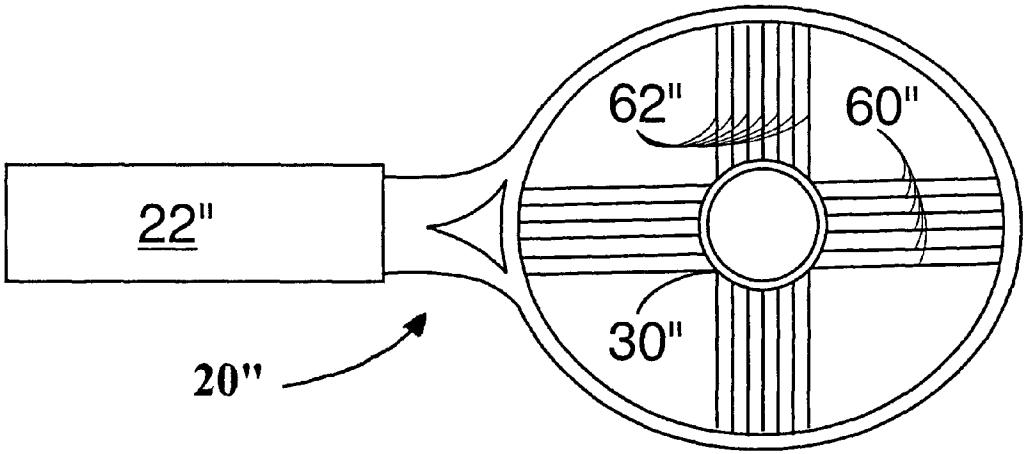
FIG. 5 is a perspective front view of a third embodiment.
Figure 6:
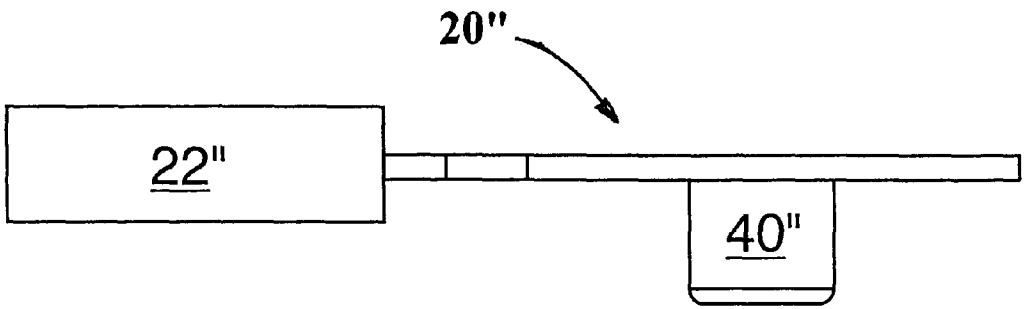
FIG. 6 is a side view of the third embodiment.

A third embodiment of the swing training device of the present invention is depicted generally at 20" in FIGS. 5 and 6. This third embodiment is designed for swing training a stringed racket such as a tennis/racquetball/squash racket having a first handle portion 22" and a second racket head portion 24". Ring means 30" which supports net 40" preferably serves as an inner terminus for horizontal strings 60" and vertical strings 62". Inner diameter $d_2$ will, therefore, be 1" larger than the associated ball to allow clearance for the knots (not shown). The remaining strings (not shown) will be interwoven as on a conventional racket. Alternatively, these strings could be omitted from swing training device 20".

Swing training device 20, 20', 20" of the present invention, with repeated use, will train the user to consistently engage the associated ball with the sweet spot of the sporting goods device, be that a baseball bat, a golf club or a tennis racket. As the user develops the feel of hitting the ball with the sweet spot of the device, her/his performance in her/his sport will be significantly enhanced. It will be understood that swing training device 20 is not designed to be used with fast pitch baseballs but, rather, intended for lob pitch or self-toss applications, which with repetition, will develop the hand-eye coordination needed to consistently hit the sweet spot on the bat. Similarly, for the golf club 20' and the racket 20", the training device is intended for "half speed" drills.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A swing training device for teaching a ballplayer to contact a baseball with the sweet spot of a baseball bat, said swing training device comprising a) a first element consisting of a handle portion of said baseball bat, said handle portion terminating at an upper end adjacent said sweet spot, said upper end having an arcuate shape with a radius of curvature slightly exceeding a radius of curvature of the baseball;

b) a second element consisting of a cap portion of said baseball bat, said cap portion terminating at a lower end adjacent said sweet spot, said lower end having an arcuate shape with a radius of curvature slightly exceeding the radius of curvature of the baseball;

c) a third element consisting of a separate ring means surrounding said sweet spot and having a external radius of curvature matching said radius of curvature of said upper end of said handle portion and said lower end of said cap portion;

d) a fourth element consisting of a ball catching net having a first end wrapped around said ring means to secure said net in place;

e) securement means engaging between said separate ring means and said upper end of said handle portion and between said separate ring means and said lower end of said cap portion uniting these four elements into a unitary structure;

whereby when said baseball bat is swung at the ball and said baseball bat is positioned such that the ball would engage said sweet spot, the ball will be captured in said ball catching net.

2. The swing training device of claim 1 wherein said securement means comprises wood screws extending through said ring means into said handle portion and said cap portion respectively.

* * * * *